United States Patent [19]

Kobayashi et al.

[11] 4,281,984

[45] Aug. 4, 1981

[54] METHOD OF HEATING A SIDE-BURNER TYPE HEATING FURNACE FOR SLAB

[75] Inventors: Zenjiro Kobayashi; Masaki Aihara; Kuniaki Sato, all of Chiba, Japan

[73] Assignee: Kawasaki Steel Corporation, Kobe, Japan

[21] Appl. No.: 58,739

[22] Filed: Jul. 18, 1979

[51] Int. Cl.[3] ..... F27D 3/00; F27D 13/00

[52] U.S. Cl. ..... 432/9; 431/185; 432/12

[58] Field of Search ..... 432/9, 11, 12, 18, 19, 432/20, 25; 431/181, 185, 187, 188; 239/400, 416.1

[56] References Cited

U.S. PATENT DOCUMENTS

| | | | |
|---|---|---|---|
| 1,953,590 | 4/1934 | Cone | 431/185 |
| 3,726,515 | 4/1973 | Knaak | 432/9 |
| 3,795,478 | 3/1974 | Knaak | 432/25 |

FOREIGN PATENT DOCUMENTS

| | | | |
|---|---|---|---|
| 862035 | 3/1961 | United Kingdom | 432/25 |

*Primary Examiner*—John J. Camby

*Attorney, Agent, or Firm*—Balogh, Osann, Kramer, Dvorak, Genova & Traub

[57] ABSTRACT

Slabs can be uniformly heated by the use of a side-burner type heating furnace having flame length-variable type burners in the side walls, each burner consisting of an inner air flow nozzle, a fuel gas nozzle and an outer air flow nozzle arranged concentrically, and by adjusting the ratio of the flow rate of air passing through the inner air flow nozzle to the flow rate of air passing through the outer air flow nozzle depending upon the variation of the flow rate of fuel gas.

2 Claims, 11 Drawing Figures

METHOD OF HEATING A SIDE-BURNER TYPE HEATING FURNACE FOR SLAB

BACKGROUND OF THE INVENTION

1. Field of the Invention

The present invention relates to a method of heating slabs by a side-burner type heating furnace, and particularly to a method of heating slabs by a heating furnace provided at its side walls with burners capable of controlling the flame length.

2. Description of the Prior Art

In general, slabs produced by a slabbing or a continuous casting are heated in a heating furnace up to a predetermined temperature necessary for rolling the slab. The heating furnace is generally used in the form of a continuous heating furnace from the view point of the efficiency, but may be used in the form of a batch system heating furnace in the heating of special steel. Particularly, in the heating of special steel, a so-called side-burner type heating furnace, that is, a box type furnace, which has no nose portion and is provided with burners at its both side walls, is generally used in order to heat uniformly a plurality of slabs in one batch and to utilize effectively the space of the furnace. However, in the conventional side-burner type heating furnace, temperature difference occurs in its width direction to cause difficulties in the uniform heating of a slab and to cause temperature difference in the length direction of the slab. As the result, the dimensional accuracy in the rolling of the slab is often adversely affected in both the continuous heating and the batch system heating. Such temperature difference in the width direction of the furnace is mainly due to the burning state of burners, and the temperature of a furnace is often higher is the center portion than in the side portion.

Further, the amount of heat to be supplied to a heating furnace for slab varies noticeably depending upon the variation of heating load, and is sometimes smaller than the lower limit of the amount of heat capable of maintaining the stable burning state of burners. In this case, when a conventional heating furnace is used, a high oxygen operation must be carried out in a high air/fuel ratio to maintain steadily the burning state of the burner. However, the high oxygen operation has such drawbacks that the burning temperature is low, a large amount of fuel is required, and further the concentration of nitrogen oxide in the waste gas is high.

SUMMARY OF THE INVENTION

The present invention aims to obviate the above described drawbacks and to provide a heating furnace capable of heating uniformly a slab and capable of carrying out always a stable low oxygen operation.

That is, one of the features of the present invention is the provision of a method of heating a side-burner type heating furnace for slabs, comprising using flame length-variable type burners in the furnace, each burner consisting of an inner air flow nozzle, a fuel gas nozzle and an outer air flow nozzle arranged concentrically, and adjusting the ratio of the flow rate of air passing through the inner air flow nozzle to the flow rate of air passing through the outer air flow nozzle depending upon the variation of the flow rate of fuel gas.

Another object and feature of the present invention can be easily understood from the following descriptions referring to the accompanying drawings.

DETAILED DESCRIPTION OF THE PREFERRED EMBODIMENT

Prior to the explanation of the present invention, a brief explanation will be made with respect to a side-burner type heating furnace applicable to the method of the present invention referring to FIGS. 1-*a*, 1-*b* and 2.

Figure 1A:
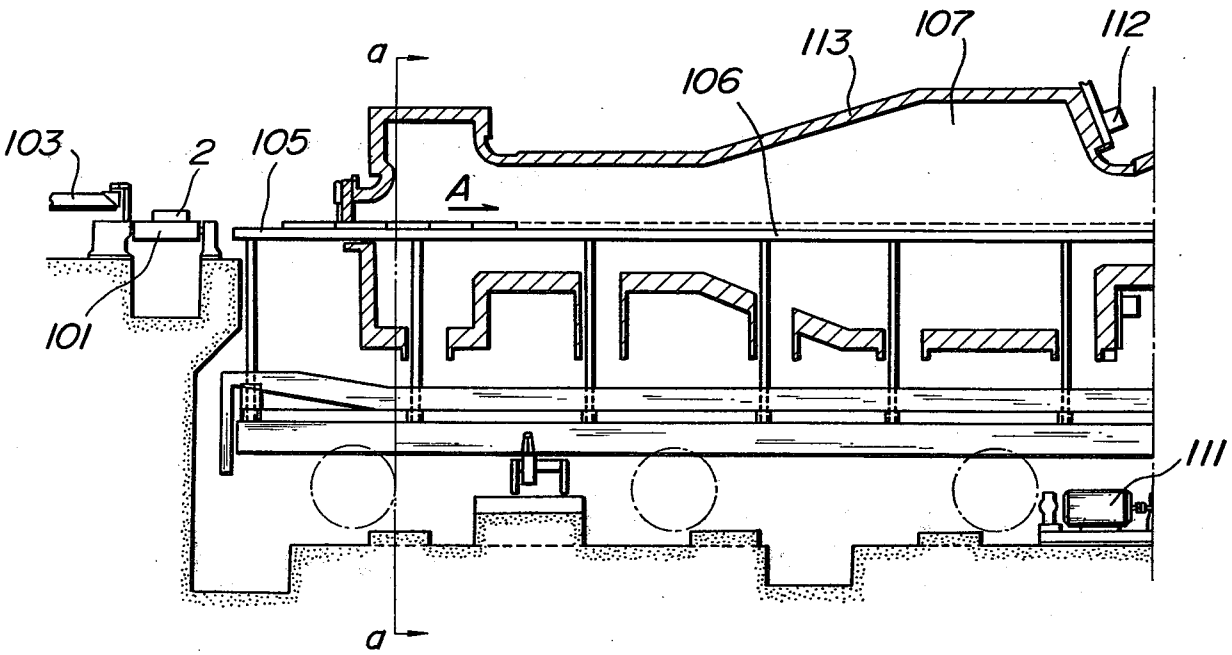
FIGS. 1-*a* and 1-*b* are diagrammatic longitudinal sectional views of a fore half and a latter half of a side-burner type heating furnace applicable to the method of the present invention, respectively.
Figure 1B:
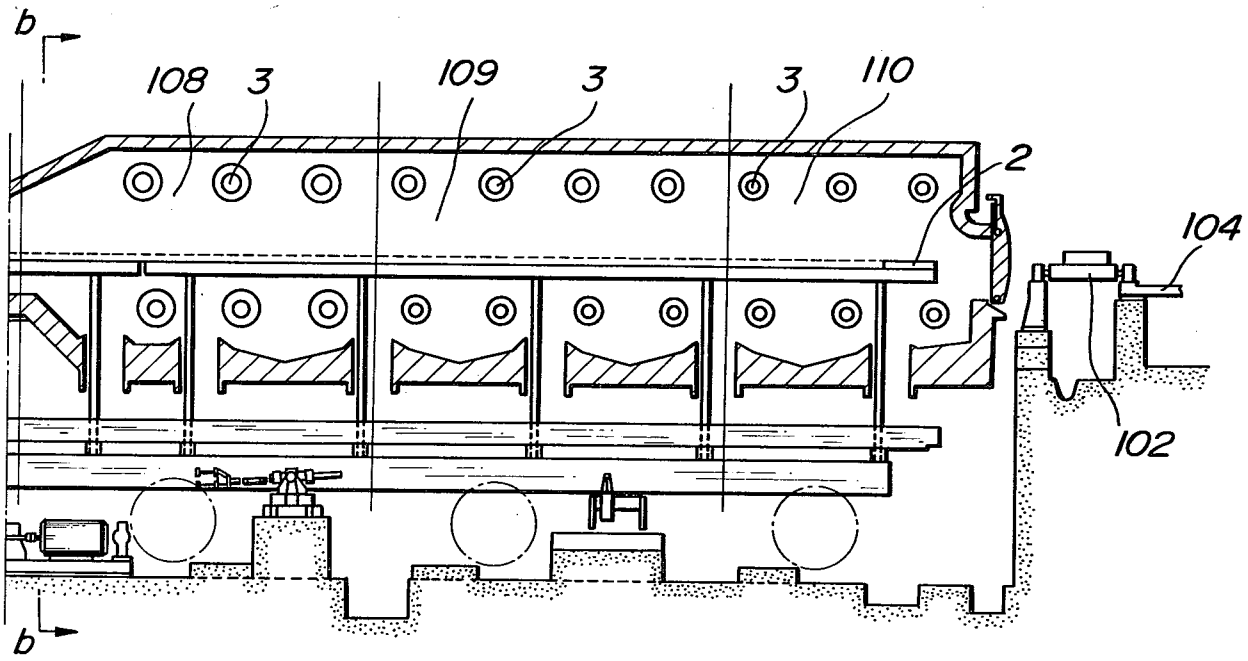
Figure 2:
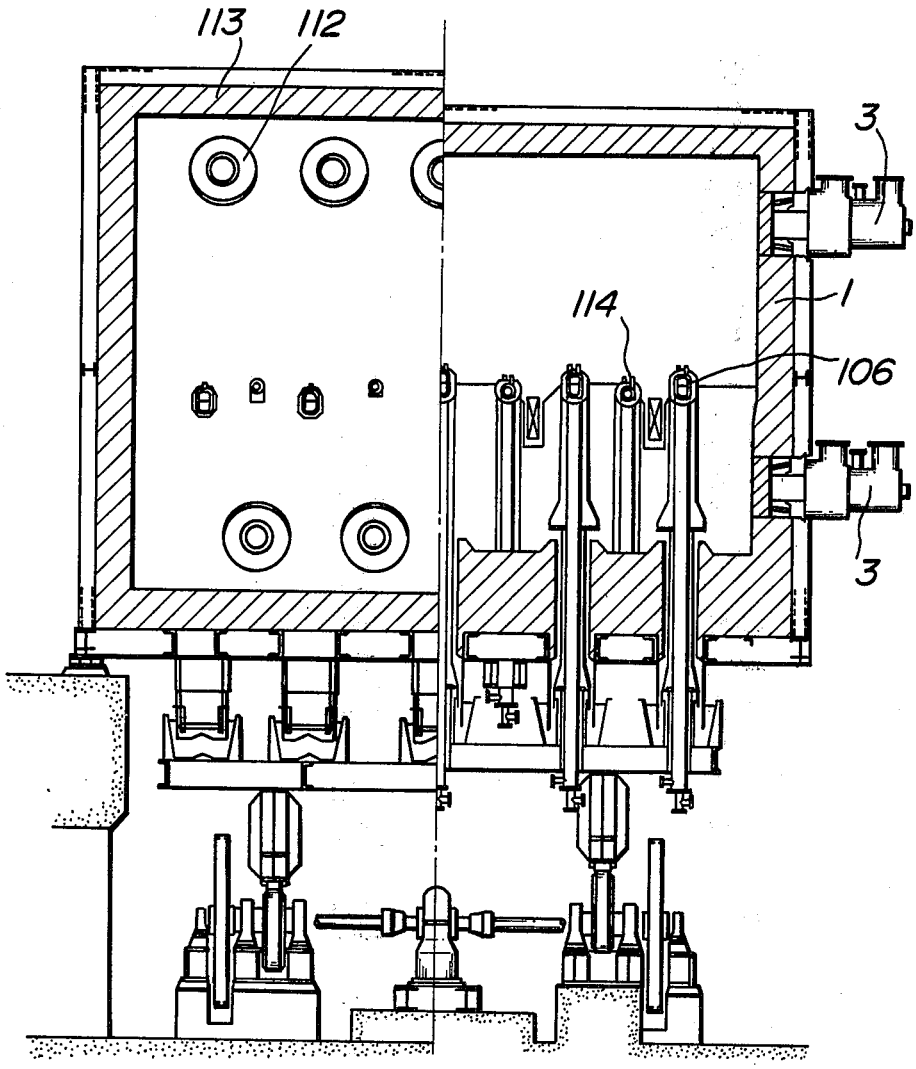
FIG. 2 is a diagrammatic cross-sectional view of the heating furnace shown in FIGS. 1-*a* and 1-*b*, the left half and right half views being taken on a line a—a in FIG. 1-*a* and a line b—b in FIG. 1-*b*, respectively.

FIGS. 1-*a* and 1-*b* are diagrammatic longitudinal sectional views of a fore half and a latter half of a side-burner type heating furnace applicable to the method of the present invention respectively, and FIG. 2 is a diagrammatic cross-sectional views of the heating furnace shown in FIGS. 1-*a* and 1-*b*, the left half and right half views being taken on a line a—a in FIG. 1-*a* and on a line b—b in FIG. 1-*b*, respectively. The furnace is a commonly used walking beam type eight zone heating furnace.

Referring to FIGS. 1-*a* and 1-*b*, a slab 2 arranged on an entry table 101 is moved onto an inlet skid 105 by means of a pusher 103 and carried into the furnace by means of carrying skids 106 driven by a motor 111. The slab moves in the furnace in the arrow direction A, and is heated in a preliminarily heating zone 107, in a first heating zone 108, in a second heating zone 109 and in a soaking zone 110. The slab heated up to a given temperature is moved on a delivery table 102 by means of an exterior 104 and then conveyed to a roller.

The heating furnace comprises a preliminarily heating zone 107 provided with axial burners 112 at its upper and lower portions and a side-burner type heating furnace portion composed of a first heating zone 108, a second heating zone 109 and a soaking zone 110 provided with side burners 3 secured to the upper and lower portions of both side walls thereof so that the burners secured to the opposite side walls are substantially opposed to each other.

In FIGS. 1-*a*, 1-*b* and 2, the numeral 113 represents a furnace wall, and the numeral 114 represents a fixed skid.

This heating furnace is used for heating not only ordinary steel and stainless steel, but also special steels, such as silicon steel and the like. In the heating for ordinary steel and stainless steel, a continuous operation is carried out, and in the heating for special steels, such as silicon steel and the like, a batch operation is carried out. When the batch operation is carried out, slabs to be heated in one batch operation are arranged in the first heating zone, second heating zone and soaking zone, and one batch operation is carried out.

The present invention will be explained in detail referring to the drawings.

Figure 3:
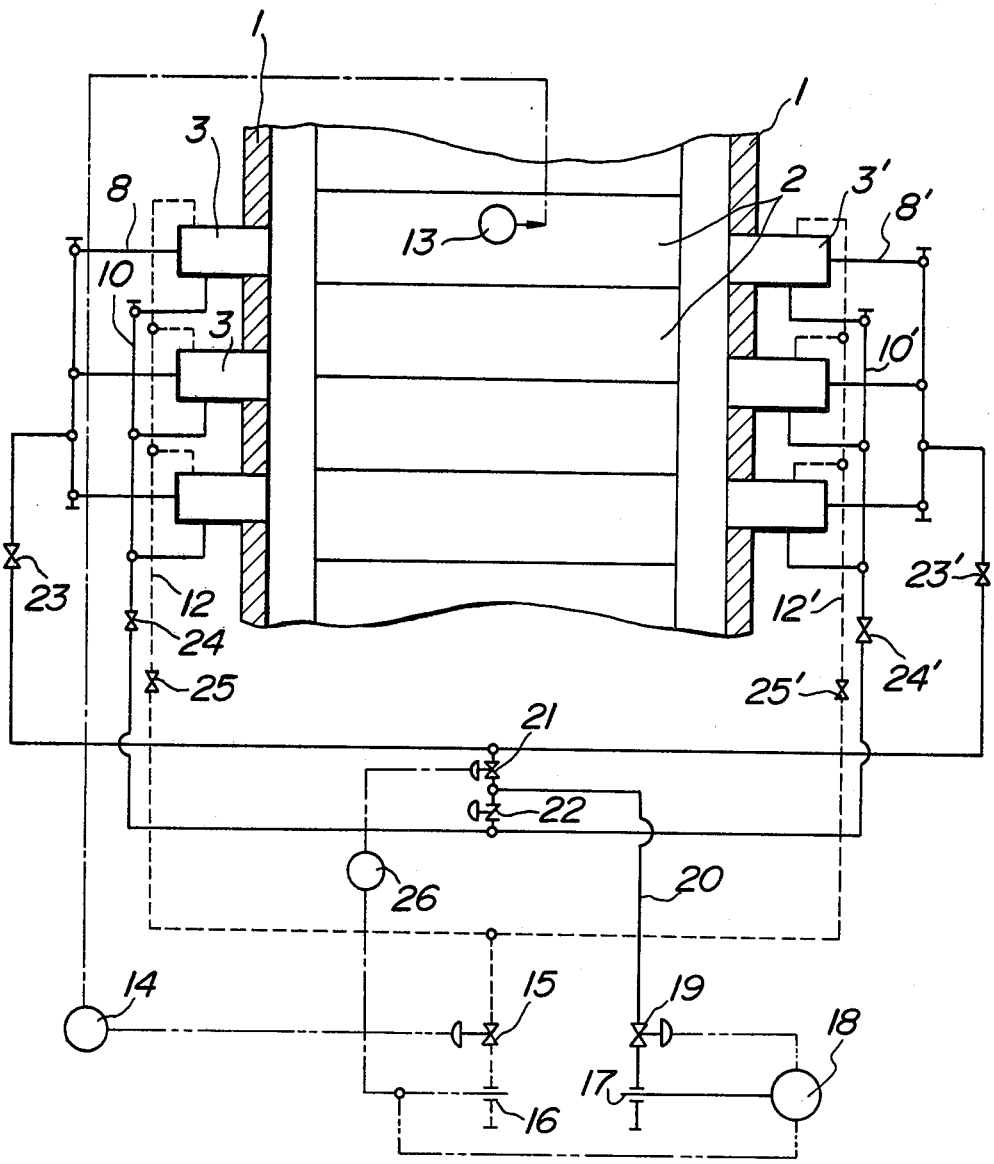
FIG. 3 is a diagrammatic view showing the method of heating slabs by the use of side burners secured to the heating furnace, and a piping system for the burners according to the present invention.

FIG. 3 is a diagrammatic view showing the method of heating slabs by the use of side burners secured to the heating furnace, and a piping system for the burners according to the present invention.

Referring to FIG. 3, the numeral 1 represents a side wall of the side-burner type heating furnace portion of the heating furnace, the numeral 2 represents a slab which moves in the furnace, and the numerals 3 and 3' represent a plurality of side burners secured to the side wall 1 directing to the interior of the furnace.

Figure 4:
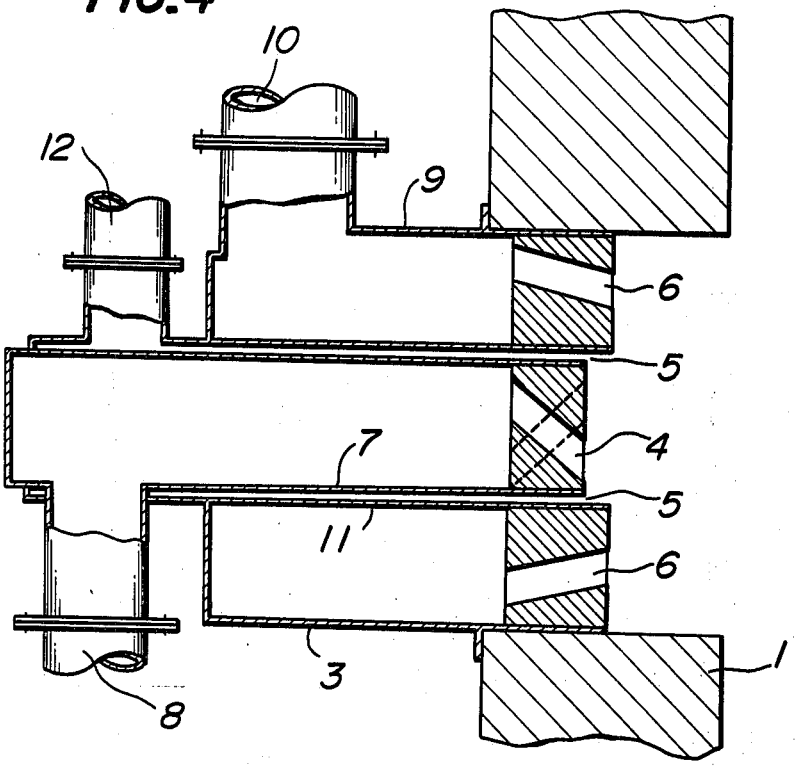
FIG. 4 is an enlarged cross-sectional view of the nozzle of the burners.

FIG. 4 is an enlarged cross-sectional view of the nozzle of the side burners 3 and 3'. The nozzle of each side burner 3 or 3' is constituted with an inner air flow nozzle 4, a fuel gas nozzle 5 and an outer air flow nozzle 6 arranged concentrically. The fuel gas nozzle 5 is arranged between inner air flow nozzle 4 and outer air flow nozzle 6. The inner air flow nozzle 4 is connected to an inner air flow pipe 8 through an inner air flow conduit 7, the outer air flow nozzle 6 is connected to an outer air flow pipe 10 through an outer air flow conduit 9, and the fuel gas nozzle 5 is connected to a fuel gas pipe 12 through a fuel gas conduit 11.

Since the side burner has the above described structure, the fuel gas is enveloped by the inner and outer air flows and burnt. The length of the flame is changed over a wide range by changing the ratio of the inner air flow rate to the outer air flow rate.

The flow rate of fuel gas to be supplied to the burner 3 or 3' is regulated by a flow rate control valve 15, which cooperates with a temperature regulator 14, based on the signal transmitted to the temperature regulator 14 from a thermocouple 13 arranged in the furnace. The flow rate of air to be supplied to the burner is regulated by a control valve 19 so that the air is supplied to the burner in a predetermined air/fuel ratio, based on the action of a gas flow meter 16, an air flow meter 17 and an air/fuel ratio regulator 18. Further, an inner air flow rate control valve 21 and an outer air flow rate control valve 22 are connected to an air main pipe 20, and air flow passed through the control valve 19 is separated into an inner air flow and an outer air flow in a predetermined inner air flow rate/outer air flow rate ratio by operating at least one of the control valves 21 and 22 based on the action of the gas flow meter 16 and an inner air flow rate/outer air flow rate ratio regulator 26.

In FIG. 3, the numeral 23 or 23' represents a shut-off valve for inner air flow arranged in an inner air flow pipe line 8 or 8' respectively, the numeral 24 or 24' represents a shut-off valve for outer air flow arranged in an outer air flow pipe line 10 or 10' respectively, and the numeral 25 or 25' represents a shut-off valve for fuel gas arranged in a fuel gas pipe line 12 or 12' respectively. The above described piping system and side burners are arranged in the upper and lower portions of the first heating zone 108, second heating zone 109 and soaking zone 110 shown in FIGS. 1-*a* and 1-*b*.

A method of uniform heating of a slab according to the present invention will be explained hereinafter referring to experimental data. This experiment was carried out by the use of a heating furnace shown in FIGS. 1-*a* and 1-*b* having side burners and a piping system shown in FIG. 3 under a condition that the air temperature was 450°–500° C., the fuel gas temperature was 30° C., the temperature in the furnace was 1,300° C., the air/fuel ratio was 1.05 (the amount of $O_2$ in the exhaust gas was 1%), and the fuel gas was a mixture composed of blast furnace gas and coke oven gas and having a heat quantity of 2,200 Kcal/$Nm^3$.

The heating furnace used in the experiment has an effective length of 42 m and an effective width of 7,600 mm, and capable of treating 200 tons/hr (maximum) of slabs, each having a thickness of 130–260 mm, a width of 550–1,300 mm and a length of 3,600–7,000 mm. The furnace has nine skids, five of which are carrying skids and four of which are fixed skids.

Figure 5:
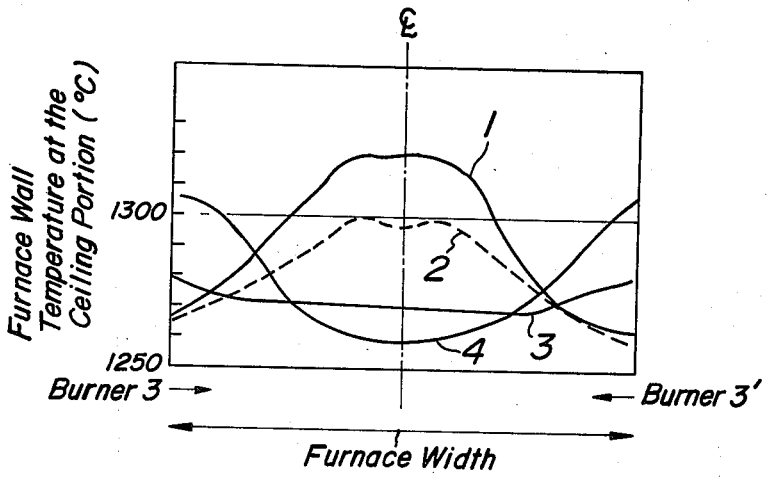
FIG. 5 is a graph showing a relation between the inner air flow rate ratio, which will be defined later, and the temperature distribution in the furnace in its width direction at the alternate burning.
Figure 6:
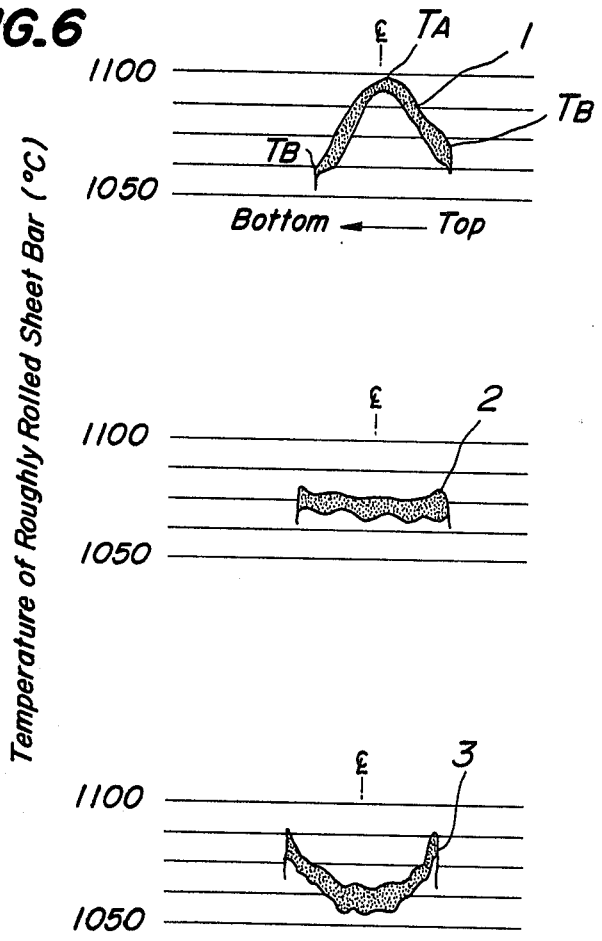
FIG. 6 is a graph showing a relation between the inner air flow rate ratio and the temperature distribution in a roughly rolled sheet bar.

The temperature distribution in the wall (at the ceiling portion) of the heating furnace in its width direction was measured by means of a PR thermocouple at various inner air flow rate ratios and at a turn down ratio of 50%. The term "inner air flow rate ratio (%)" is defined by the formula of (flow rate of inner air/flow rate of total air)$\times$100, and the term "turn down ratio (%)" is defined by the formula of (flow rate of fuel/maximum flow rate of fuel)$\times$100. The obtained results are shown in FIG. 5. In FIG. 5, the abscissa represents the furnace width and the ordinate represents the temperature, and the curves 1, 2, 3 and 4 represent temperature distributions at inner air flow rate ratios of 10%, 40%, 60% and 85%, respectively. It can be seen from FIG. 5 that when the inner air flow rate ratio is increased, the flame length is shorter, and a convex temperature distribution is changed into a concave temperature distribution. The variation of temperature distribution in a slab corresponding to the change of flame length is shown in FIG. 6. FIG. 6 shows a result of measurement, by means of a radiation thermometer, of temperature distribution in the length direction of a sheet bar obtained by roughly rolling a slab after the slab is continuously heated at a turn down ratio of 30–60% and at various inner air flow rate ratios. In FIG. 6, the numerals 1, 2 and 3 represent temperature distributions in the sheet bar at inner air flow rate ratios of 10–15%, 50–65% and 70–85%, respectively. It can be seen from FIG. 6 that the variation of the temperature distribution in a sheet bar due to the variation of inner air flow rate ratio is agreed with the variation of the temperature distribution in the furnace wall in the width description of the furnace due to the variation of inner air flow rate ratio.

Figure 7:
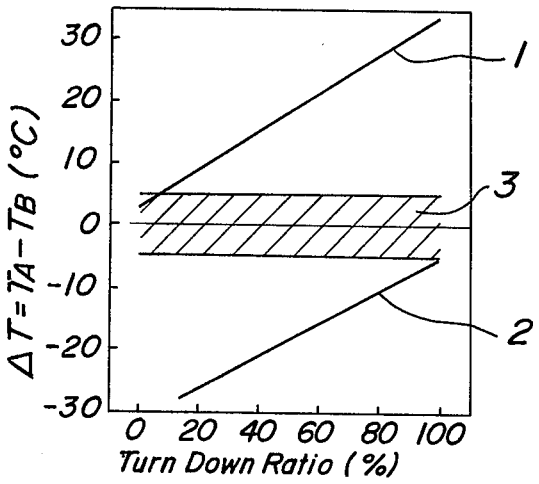
FIG. 7 is a graph showing a relation between the turn down ratio, which will be defined later, and the slab temperature difference, which will be defined later.

FIG. 7 shows a relation between the turn down ratio and the slab temperature difference (°C.) ($\Delta T = T_A - T_B$, wherein $T_A$ means the temperature of the center portion of a slab and $T_B$ means the temperature of the edge portion of the slab). In FIG. 7, the abscissa represents the turn down ratio, and the ordinate represents the slab temperature difference, that is, the sheet bar temperature difference. In FIG. 7, the straight line 1 shows the slab temperature difference at a long flame, that is, at an inner air flow rate ratio of 0%, and the straight line 2 shows the slab temperature difference at a short flame, that is, at an inner air flow rate ratio of 85%. When it is intended to heat uniformly a slab within an allowable temperature tolerance shown in the region 3 in FIG. 7 by the use of burners having the above described property, it is necessary that the flame length is controlled by changing the inner air flow rate ratio, for example, within the range 1 in FIG. 8 corresponding to the variation of the turn down ratio. The ratio of inner air flow rate to outer air flow rate is changed in the following manner. For example, the outer air flow rate control valve 22 is set to a certain opened degree, and the inner air flow rate control valve 21 is opened according to the following formula corresponding to the turn down ratio:

$$[A_I]=A\times[G]+B$$

In the formula, $[A_I]$: Opened degree of inner air flow rate control valve

[G] : Amount of turned down gas

A and B: Parameters.

Figure 8:
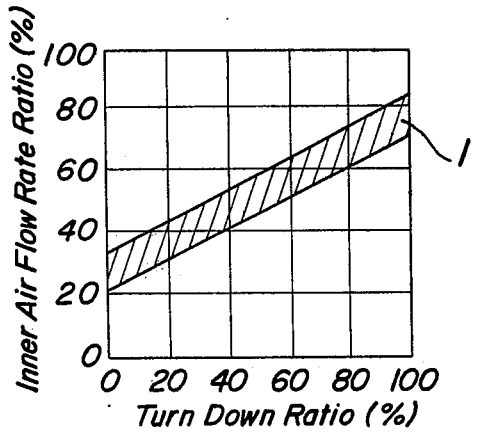
FIG. 8 is a graph showing a relation between the turn down ratio and the inner air flow rate ratio, which indicates a slab temperature difference within an allowable tolerance.

FIG. 8 is a graph showing a relation between the turn down ratio and the inner air flow rate ratio, which indicates a slab temperature difference within an allowable temperature tolerance. In FIG. 8, the abscissa represents the turn down ratio and the ordinate represents the inner air flow rate ratio. When the inner air flow rate ratio is selected within the range 1 in FIG. 8 corresponding to the turn down ratio, the slab temperature difference can be maintained within the region 3 in FIG. 7.

Figure 9:
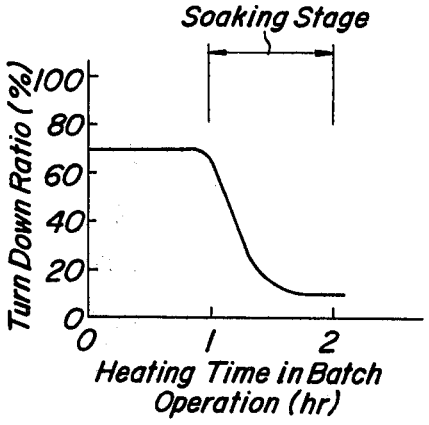
FIG. 9 is a graph showing a relation between the heating time for a slab and the turn down ratio.

Thus, the temperature in the heating furnace can be uniformly maintained in its width direction, and the temperature of a slab also becomes substantially uniform in its length direction. In the batch system heating operation, the amount of heat to be supplied to the slab varies with the lapse of heating time. FIG. 9 shows a relation between the heating time and the turn down ratio. That is, after a slab has been heated up to a given temperature, the slab is soaked at a temperature not to cool the slab. As the result, the heating is effected at a very low turn down ratio in the soaking stage. In the experiment shown in FIG. 9, after the lapse of about 1.3–2 hours from the beginning of heating, the turn down ratio is less than 20%. Therefore, during about 1.3–2 hours after the beginning of heating, the above described temperature control in the furnace cannot be carried out.

That is, after the turn down ratio is decreased to less than 20%, the high oxygen operation must be generally carried out as described above. In the present invention, in order to obviate the disadvantage of the high oxygen operation, a so-called side by side alternate heating is carried out, wherein the shut-off valves 23 and 23', 24 and 24', 25 and 25' are operated alternately to burn and extinguish alternately left side wall group burners and right side wall group burners at a constant cycle, or a so-called zigzag alternate burning is carried out, wherein burners are separated into a pair of zigzaggedly positioned burners, and the zigzaggedly positioned burners are burnt and extinguished alternately. In any of the above described alternate burning, the turn down ratio is changed so that a slab can be uniformly heated, and at the same time the flame length is regulated by changing the inner air flow rate ratio corresponding to the variation of the turn down ratio.

Figure 10:
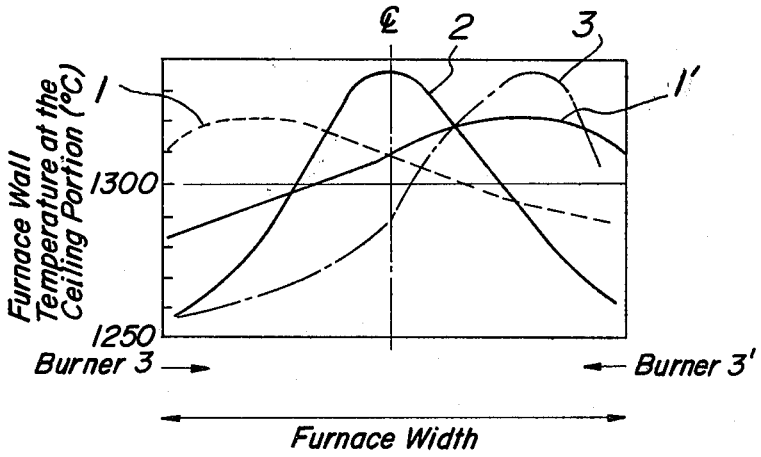
FIG. 10 is a graph showing a relation between the inner air flow rate ratio and the temperature distribution in the furnace in its width direction at the alternate burning.

In such alternate burning, since the flow rate of fuel gas to be supplied to one burner can be increased, the turn down ratio in one burner can be maintained to substantially at least 20%. FIG. 10 shows a result of an alternate burning carried out under a condition that the change-over time of burning and extinguishing is set to 5–20 minutes, the inner air flow rate ratio is controlled depending upon the turn down ratio and the flow rate of fuel gas is 260 $Nm^3/hr$ (maximum flow rate of the gas is 1,300 $Nm^3/hr$).

The temperature distribution shown in FIG. 10 was measured in the same manner as described in FIG. 5. In FIG. 10, the curve 1 represents a temperature distribution in the wall of a furnace at the ceiling portion when left side wall group burners 3 in FIG. 3 were burnt, and the curve 1' represents the temperature distribution when right side wall group burners 3' in FIG. 3 were burnt. In this experiment, the flame length was properly maintained by controlling the inner air flow rate ratio. That is, according to the present invention, the above described temperature distributions shown by the curves 1 and 1' can be alternately obtained, and a slab can be uniformly heated. However, when the flame length is not regulated even in the above described alternate burning, temperature distributions having a locally high temperature zone are formed as shown in the curves 2 and 3 in FIG. 10, and a slab is difficult to be uniformly heated.

Further, in the conventional burning at a turn down ratio of less than 20%, the amount of nitrogen compound developed during the burning is 50–60 ppm. On the contrary, in the alternate burning of the present invention, the amount of nitrogen compound developed during the burning can be decreased to as low as 30–40 ppm. Moreover, the burning of the present invention can be carried out by the use of a fuel in an amount about 20% smaller than the amount required in the conventional burning at a turn down ratio of less than 20%.

Further, in the present invention, in addition to the above described procedures, the slab temperature is measured at several places in the width direction of the furnace, and the inner and outer air flow controlling valves can be controlled automatically and continuously so that the temperature difference in a slab in its length direction can be within the allowable tolerance shown in FIG. 7. As described above, according to the present invention, 20°–30° C. of the temperature difference in a slab in its length direction in a conventional heating system can be decreased to not more than ±5° C., and the dimensional accuracy in the rolling of a slab and other properties thereof are improved, and the formation of scales on the surface of the slab can be decreased. Further, even when the heating load decreases, a low oxygen operation can be stably carried out, and the generation of nitorgen oxide and the amount of fuel can be descreased.

What is claimed is:

1. A method of heating slabs by the use of a side-burner type heating furnace having flame length-variable type burners on both side walls thereof, each burner consisting of an inner air flow nozzle, a fuel gas nozzle and an outer air nozzle arranged concentrically, the method comprising arranging the fuel gas nozzle of each burner between the inner air flow nozzle and the outer air flow nozzle thereof, and adjusting the ratio of the flow rate of air passing through the inner air flow nozzle to the flow rate of air passing through the outer air flow nozzle depending upon the variation of the flow rate of fuel gas.

2. A method of heating slabs by the use of a side-burner type heating furnace having flame length-variable type burners on both side walls thereof, each burner consisting of an inner air flow nozzle, a fuel gas nozzle and an outer air flow nozzle arranged concentrically, the method comprising arranging the fuel gas nozzle of each burner between the inner air flow nozzle and the outer air flow nozzle, adjusting the ratio of the flow rate of air passing through the inner air flow nozzle to the flow rate of air passing through the outer air flow nozzle depending upon the variation of the flow rate of fuel gas, and further carrying out a side-by-side alternate burning or a zigzag alternate burning at a constant cycle when the turn down ratio is low.

* * * * *